US007066141B2

(12) United States Patent
Shafer et al.

(10) Patent No.: US 7,066,141 B2
(45) Date of Patent: Jun. 27, 2006

(54) LINEAR CONTROL VALVE FOR CONTROLLING A FUEL INJECTOR AND ENGINE COMPRESSION RELEASE BRAKE ACTUATOR AND ENGINE USING SAME

(75) Inventors: Scott F. Shafer, Morton, IL (US); Alan R. Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/617,289

(22) Filed: Jul. 10, 2003

(65) Prior Publication Data

US 2004/0103866 A1 Jun. 3, 2004

Related U.S. Application Data

(62) Division of application No. 09/939,416, filed on Aug. 24, 2001, now abandoned.

(51) Int. Cl.
*F01D 13/04* (2006.01)

(52) U.S. Cl. ..... 123/321; 137/625.65; 251/129.1

(58) Field of Classification Search ..... 123/321, 123/322; 137/625.5; 251/129.1, 129.09
See application file for complete search history.

(56) References Cited

U.S. PATENT DOCUMENTS

| | | | | |
|---|---|---|---|---|
| 3,367,312 | A | 2/1968 | Jonsson | |
| 3,379,214 | A | 4/1968 | Weinberg | |
| 3,683,239 | A | 8/1972 | Sturman | |
| 3,710,908 | A | 1/1973 | Muir | |
| 3,743,898 | A | 7/1973 | Sturman | |
| 4,158,348 | A | 6/1979 | Mason | |
| 4,201,116 | A | 5/1980 | Martin | |
| 4,310,143 | A * | 1/1982 | Determan | 251/30.02 |
| 4,478,250 | A * | 10/1984 | Lukasczyk et al. | 137/625.65 |
| 4,530,318 | A | 7/1985 | Semple | |
| 4,532,951 | A | 8/1985 | Fermanich | |
| 4,537,164 | A | 8/1985 | Ajiki et al. | |
| 4,572,114 | A | 2/1986 | Sickler | |
| 4,592,319 | A | 6/1986 | Meistrick | |
| 4,653,720 | A | 3/1987 | Knapp et al. | |
| 4,664,070 | A | 5/1987 | Meistrick et al. | |
| 4,688,384 | A | 8/1987 | Pearman et al. | |
| 4,690,371 | A | 9/1987 | Bosley et al. | |
| 5,000,146 | A | 3/1991 | Szucsanyi | |
| 5,117,869 | A | 6/1992 | Kolchinsky | |
| 5,188,336 | A | 2/1993 | Graner et al. | |
| 5,237,968 | A | 8/1993 | Miller et al. | |

(Continued)

FOREIGN PATENT DOCUMENTS

| | | |
|---|---|---|
| EP | 0 404 357 A2 | 5/1990 |

(Continued)

*Primary Examiner*—John T. Kwon
(74) *Attorney, Agent, or Firm*—Liell & McNeil

(57) ABSTRACT

A linear control valve is disclosed regulating the flow of fluid to hydraulically activated devices, preferably a fuel injector and an engine compression release brake. The valve includes a valve member that is moveable between a first position in which the fuel injector is, at least partially, activated, a second position in which neither the fuel injector nor the engine compression release brake is activated, and a third position in which the engine compression release brake is activated. An electrical actuator providing two permanent magnets and two oppositely wound solenoid coils moves the valve member between its three positions. The polarity of the permanent magnets are oriented such that when the solenoids are energized, one solenoid coil pulls the valve member while the other solenoid coil pushes the valve member in the same direction.

20 Claims, 4 Drawing Sheets

U.S. PATENT DOCUMENTS 5,251,671 A * 10/1993 Hiroki ..... 137/625.65
5,284,220 A * 2/1994 Shimizu et al. ..... 180/441
5,309,881 A 5/1994 Pawellek et al.
5,353,991 A 10/1994 De Nagel et al.
5,404,851 A 4/1995 Neitz et al.
5,434,549 A 7/1995 Hirabayashi et al.
5,460,329 A 10/1995 Sturman
5,494,219 A 2/1996 Maley et al.
5,526,784 A 6/1996 Hakkenberg et al.
5,546,063 A 8/1996 Hoffman
5,626,116 A 5/1997 Reedy et al.
5,713,331 A 2/1998 Unger et al.
5,738,075 A 4/1998 Chen et al.
5,809,157 A 9/1998 Grumazescu
5,934,245 A 8/1999 Miller et al.
5,957,106 A 9/1999 Maloney et al.
5,961,045 A 10/1999 Coldren et al.
5,992,390 A * 11/1999 Moyer ..... 123/481
6,039,077 A 3/2000 Schulze
6,170,524 B1 1/2001 Gray
6,745,958 B1 * 6/2004 Lei ..... 239/585.2
2002/0068508 A1 6/2002 Lefky
2003/0146295 A1 * 8/2003 Lei ..... 239/88

FOREIGN PATENT DOCUMENTS

GB 1324456 7/1973

* cited by examiner

LINEAR CONTROL VALVE FOR CONTROLLING A FUEL INJECTOR AND ENGINE COMPRESSION RELEASE BRAKE ACTUATOR AND ENGINE USING SAME

RELATION TO OTHER PATENT APPLICATION

This application is a division of Ser. No. 09/939,416, filed Aug. 24, 2001 now abandoned with the same title.

TECHNICAL FIELD

This invention relates generally to engines, and more particularly to valves for controlling hydraulically actuated fuel injectors and engine compression release brakes.

BACKGROUND

In several diesel engines today, a number of hydraulically actuated devices, such as hydraulically actuated fuel injectors and engine compression release brakes, are coupled to each engine cylinder. Typically, each of these hydraulically actuated devices is controlled by its own individual fluid control valve. For instance, hydraulically actuated fuel injectors such as that shown in U.S. Pat. No. 5,738,075 issued to Chen et al. on Apr. 14, 1998, include a solenoid driven fluid control valve that is attached to the injector body. The control valve controls fluid pressure to both an intensifier piston and a direct control needle valve included in the injector body. While fuel injectors, and other hydraulic devices, including fluid control valves have performed adequately, there is room for improvement. For instance, it is known in the art that a reduction in the number of engine components can make the engine more robust.

The present invention is directed to overcoming one or more of the problems as set forth above.

SUMMARY OF THE INVENTION

In one aspect of the present invention, a linear control valve includes a valve body defining at least one supply passage, a first device passage and a second device passage. A valve member is at least partially positioned in the valve body and is movable along its centerline between a first position, a second position, and a third position. When in the first position, the valve member opens the supply passage to the first device passage. When in the second position, the valve member closes the supply passage to the first device passage and the second device passage. When in the third position, the valve member opens the supply passage to the second device passage. At least one electrical actuator is attached to the valve body and operably coupled to move the valve member.

In another aspect of the present invention, a method for operating a hydraulic system includes a step of connecting a source of high pressure fluid, a low pressure reservoir, a first hydraulic device and a second hydraulic device to a linear control valve. In order to at least partially activate the first hydraulic device, a portion of the linear control valve moves along a line to its first position at which it fluidly connects the first hydraulic device to a source of high pressure fluid. In order to deactivate the first hydraulic device and the second hydraulic device, a portion of the linear control valve moves along a line to its second position at which it fluidly connects the first hydraulic device and the second hydraulic device to a low pressure reservoir. In order to at least partially activate the second hydraulic device, a portion of the linear control valve moves along a line to its third position at which it fluidly connects the second hydraulic device to a source of high pressure fluid.

In yet another aspect of the present invention, an engine has an engine housing defining a plurality of cylinders. A hydraulic system is attached to the engine housing and includes at least one source of high pressure fluid, at least one low pressure reservoir, at least one fuel injector and at least one engine compression release brake fluidly connected to at least one linear control valve. Each linear control valve has a portion movable along a line between a first position in which one fuel injector is fluidly connected to the source of high pressure fluid, a second position in which the one fuel injector and one engine compression release brake are fluidly connected to the low pressure reservoir, and a third position in which the one engine compression release brake is fluidly connected to the source of high pressure fluid.

DETAILED DESCRIPTION

Figure 1:
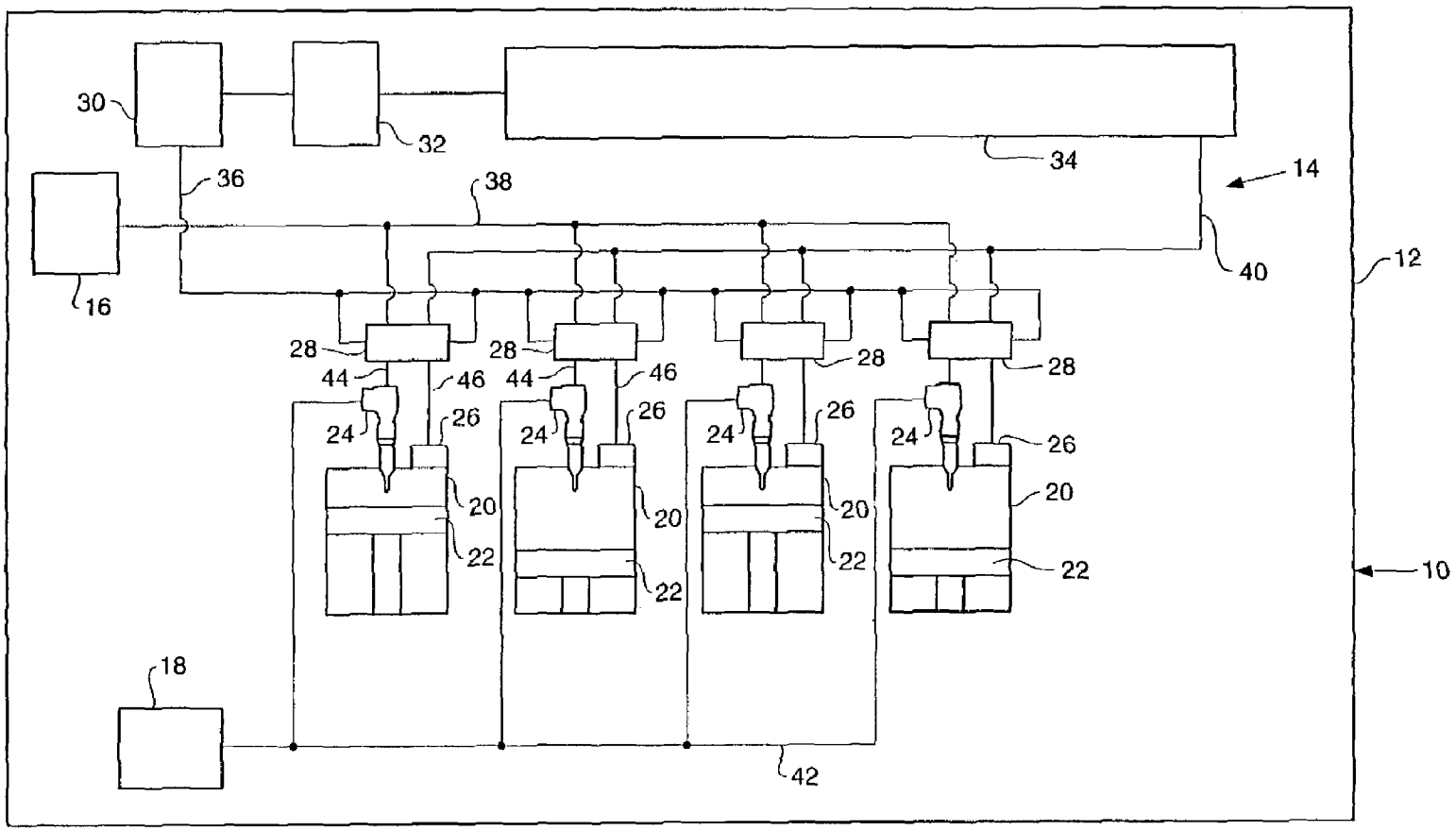
FIG. 1 is a schematic representation of an engine according to the present invention.

Referring to FIG. 1, there is shown an engine 10 according to the present invention. A low pressure actuation fluid reservoir 30 is provided in engine 10 and preferably includes an amount of low pressure engine lubricating oil. While low pressure actuation fluid reservoir 30 is preferably an oil pan that has engine lubricating oil, it should be appreciated that other fluid sources having an amount of available fluid, such as coolant, transmission fluid or fuel, could instead be used. A high pressure pump 32 pumps actuation fluid from low pressure actuation fluid reservoir 30 and delivers the same to a source of high pressure actuation fluid 34. High pressure actuation fluid flowing out of source of high pressure actuation fluid 34 is delivered via actuation fluid supply line 40 to a hydraulic system 14 provided in engine 10, and oil is returned to low pressure actuation fluid reservoir 30 via low pressure drain line 36 after it has performed work in the hydraulic system 14. Engine 10 also has an engine housing 12 that defines a plurality of engine cylinders 20.

Each of the engine cylinders 20 defined by engine housing 12 has a movable engine piston 22. Each piston 22 is movable between a bottom dead center position and a top dead center position. For a typical four-cycle diesel engine 10, the advancing and retracting strokes of engine piston 22 correspond to the four stages of engine 10 operation. When engine piston 22 retracts from its top dead center position to its bottom dead center position for the first time, it is undergoing its intake stroke and air can be drawn into engine cylinder 20 via an intake valve (not shown). When engine piston 22 advances from its bottom dead center position to its top dead center position for the first time it is undergoing its compression stroke and air within engine cylinder 20 is compressed. At around the end of the compression stoke, when engine piston 22 is nearing its top dead center position, one of three things can occur: if engine 10 is operating in a power mode then injection will occur, compression release will occur if engine 10 is operating in a braking mode, or if engine 10 is operating in a freewheeling mode then neither of these will occur. Assuming operation in a power mode, fuel can be injected into engine cylinder 20 by fuel injector 24, and combustion within engine cylinder 20 can occur spontaneously due to the high temperature of the compressed air. This combustion drives engine piston 22 downward toward its bottom dead center position, for the power stroke of engine piston 22. Finally, when engine piston 22 once again advances from its bottom dead center position to its top dead center position, post combustion products remaining in engine cylinder 20 can be vented via an exhaust valve (not shown), corresponding to the exhaust stroke of engine piston 22. While engine 10 has been illustrated as a four cycle, four-cylinder engine, it should be appreciated that any desired number of cylinders could be defined by engine housing 12. In addition, the engine could be a two cycle engine with appropriate changes to the intake and exhaust valve actuators, and/or be an engine capable of operating in both two-stroke and four-stroke modes.

Each engine cylinder 20 is operably connected to a number of hydraulically actuated devices. As illustrated in FIG. 1, these hydraulic devices are preferably a hydraulically actuated fuel injector 24 and an engine compression release brake 26. Fuel injector 24 is fluidly connected to source of fuel fluid 18 and delivers fuel to engine cylinder 20 for combustion, while engine compression release brake 26 controls release of compressed air from engine cylinder 20 when braking is desirable. A linear control valve 28 is fluidly connected to fuel injector 24 and engine compression release brake 26 for each cylinder 20. Linear control valve 28 acts as an actuation fluid flow control valve for both fuel injector 24 and engine compression release brake 26.

Figure 2:
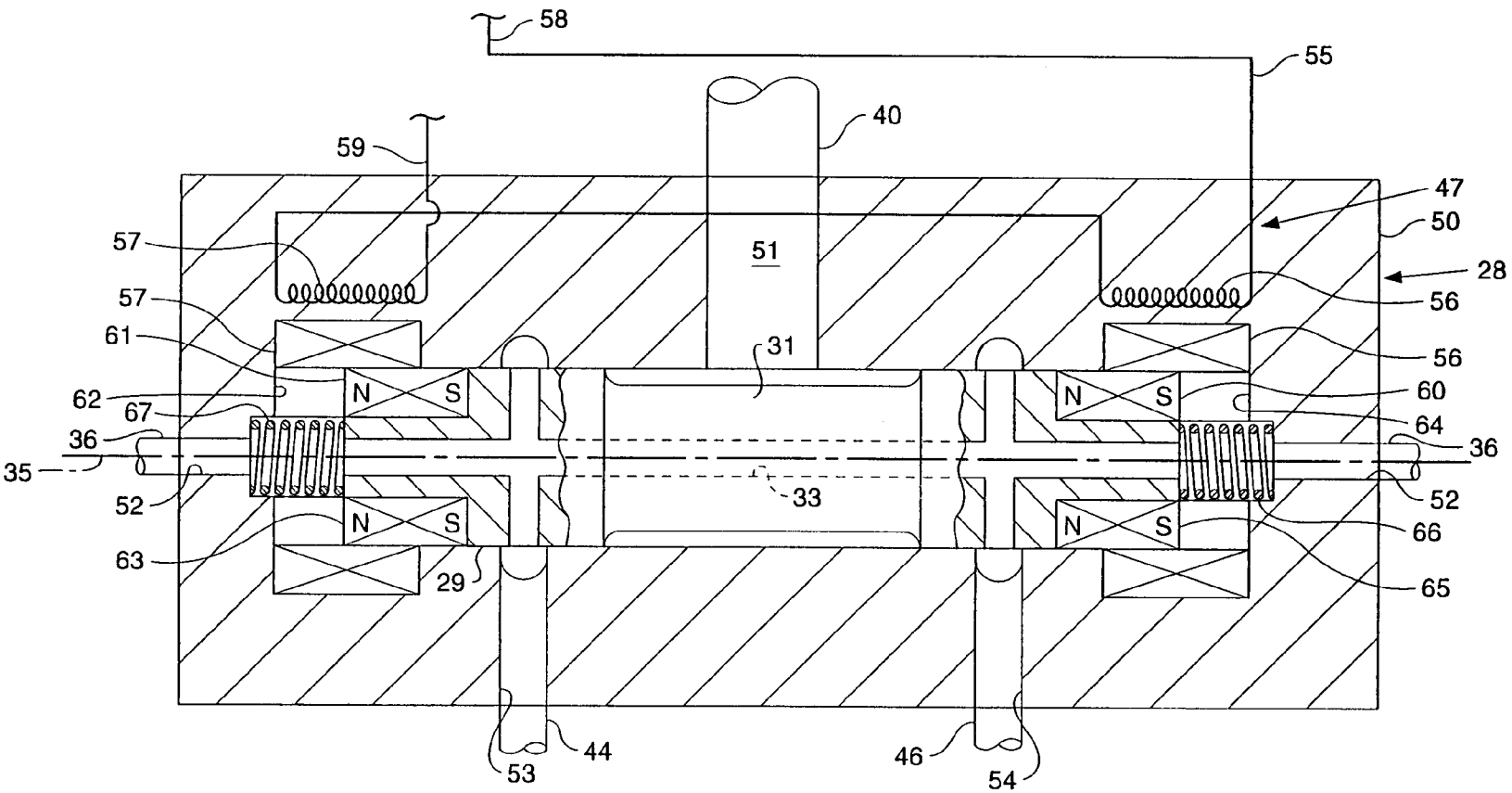
FIG. 2 is a schematic representation of a three position linear control valve in its second position according to the present invention.

Referring to FIG. 2, there is shown a sectioned view through linear control valve 28 as fluidly connected to fuel injector 24 via injector supply/drain line 44 and engine compression release brake 26 via brake supply/drain line 46. Linear control valve 28 includes a valve body 50 and a movable spool valve member 29. Spool valve member 29 defines an internal passage 33 and an annulus 31. Spool valve member 29 is movable along its centerline 35 between a first position, a second position (as shown), and a third position. Valve body 50 defines supply passage 51 that is fluidly connected to source of high pressure actuation fluid 34 via actuation fluid supply line 40. Depending on the linear position of spool valve member 29 within valve body 50, supply passage 51 can be fluidly connected to either first device passage 53 or second device passage 54, all defined by valve body 50. However, supply passage 51 preferably cannot be fluidly connected to both first device passage 53 and second device passage 54 simultaneously. Linear control valve 28 also includes a drain passage 52 that is fluidly connected to low pressure actuation fluid reservoir 30 via drain line 36. Spool valve member 29 is biased to its second position by first biasing spring 66 and second biasing spring 67, which are positioned in contact with opposite ends of spool valve member 29. When spool valve member 29 is in its second position as shown, first device passage 53 and second device passage 54 are fluidly connected to drain passage 51 via internal passage 33 of spool valve member 29. When spool valve member 29 is in its second position, first stop surface 63 and second stop surface 65 of spool valve member 29 are out of contact with valve body 50.

Referring back to FIG. 1, linear control valve 28 has an electrical actuator 47 that is in control communication with electronic control module 16 via communication line 38. The electrical actuator includes a first solenoid coil 56 and a second solenoid coil 57, both mounted in valve body 50 adjacent opposite ends of spool valve member 29 and wound in opposite directions. Electrical actuator 47 also includes first permanent magnet 60 and second permanent magnet 61, both attached to opposite ends of spool valve member 29. First solenoid coil 56 is adjacent first permanent magnet 60, and second solenoid coil 57 is adjacent second permanent magnet 61. While both solenoid coils 56 and 57 are wound in opposite directions, the polarity of both permanent magnets are oriented in the same direction.

In the preferred embodiment, first solenoid coil 56 and second solenoid coil 57 are parts of the same electrical circuit 55, but are wound in opposite directions. When a voltage is applied across first terminal 58 and second terminal 59, both solenoid coils are energized, but first solenoid coil 56 will repel first permanent magnet 60 while the oppositely wound second solenoid coil 57 will attract second permanent magnet 61, causing spool valve member 29 to move to the left along its centerline 35 to its first position against the action of second biasing spring 67. When spool valve member 29 is in its first position resting against first stop 62, first stop surface 63 of spool valve member 29 is in contact with valve body 50. Supply passage 51 is fluidly connected to first device passage 53, while second device passage 54 remains fluidly connected to drain passage 52. When electrical current flows in the reverse direction across first terminal 58 and second terminal 59, again both solenoid coils are energized, but first solenoid coil 56 will attract first permanent magnet 60 while second solenoid coil 57 will repel second permanent magnet 61, causing spool valve member 29 to move to the right along its centerline 35 to its third position against the action of first biasing spring 66. When spool valve member 29 is in its third position resting against second stop 64, second stop surface 65 of spool valve member 29 is in contact with valve body 50. Supply passage 51 is fluidly connected to second device passage 54, and drain passage 52 is fluidly connected to first device passage 53. Unlike conventional electrical actuators in which one energized solenoid coil creates an electromagnetic field that attracts an armature in order to move a valve member, this preferred embodiment allows two oppositely oriented solenoid coils to both push and pull simultaneously on permanent magnets to move the spool valve member 29 with a substantially higher magnetic force. When the electrical actuator 47 is de-engerized, spool valve member 29 moves toward and comes to rest in its second or middle position as shown.

It should be appreciated, however, that controlling the movement of spool valve member 29 along its centerline 35 could also be accomplished by placing first solenoid coil 56 and second solenoid coil 57 on different electrical circuits and by attaching conventional armatures rather than permanent magnets to the opposite ends of spool valve member 29. Electrical current could be applied to the electrical circuit including a first solenoid coil, so that only the first solenoid coil would be energized and pull the adjacent conventional armature against second stop 64, causing spool valve member 29 to move to its third position against the action of first biasing spring 66. Electrical current could be applied to the second electrical circuit that energizes a second solenoid coil to attract the adjacent conventional armature against first stop 62, causing spool valve member 29 to move to its first position against the action of second biasing spring 67.

When neither coil is energized, spool valve member will move toward its middle position under the action of biasing springs 66 and 67.

In yet another alternative that would perform identical to the previous alternative and utilize conventional armatures, both first solenoid coil 56 and second solenoid coil 57 could be provided in the same electrical circuit, however, diodes could be positioned in the circuit to prevent current from flowing through both first solenoid coil and second solenoid coil simultaneously. When current is supplied in one direction, the diodes could permit current to flow to one of the solenoid coils but not the other, causing the conventional armature attached to the spool valve member 29 to pull toward the energized solenoid coil against the action of the biasing spring. Upon reversal of the current, the diodes could permit the current to flow to the other of the two solenoid coils, causing the conventional armature attached to spool valve member 29 to pull the other direction against the action of the other biasing spring.

Figure 3:
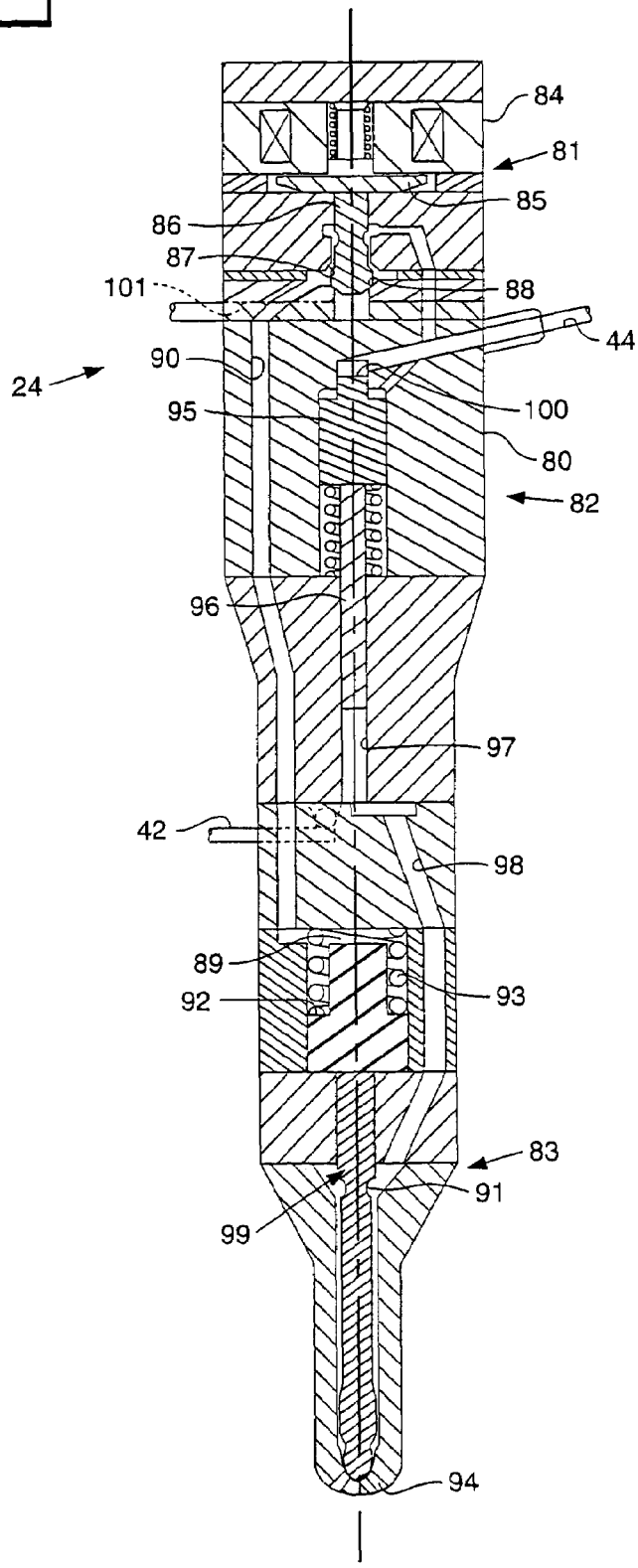
FIG. 3 is a sectioned side diagrammatic representation of a fuel injector according to the present invention.

Referring to FIG. 3, there is a sectioned view through an example fuel injector 24 that is fluidly connected to a linear control valve 28 via injector supply/drain line 44 and first device passage 53. Injector body 80 of fuel injector 24 contains a control portion 81, a pressure intensifying portion 82 and a nozzle portion 83. In pressure intensifying portion 82 of injector body 80, an intensifier piston 95 is movably positioned and has a piston hydraulic surface 100 that is exposed to fluid pressure in injector supply/drain line 44. Intensifier piston 95 is biased toward a retracted, upward position as shown by a biasing spring. A plunger 96 is also moveably positioned in injector body 80 and moves in a corresponding manner with intensifier piston 95. When pressure within injector supply/drain line 44 is sufficiently high, such as when it is open to source of high pressure actuation fluid 34 by linear control valve 28, intensifier piston 95 is moved toward its advanced position. When intensifier piston 95 is moved toward its advanced position, plunger 96 also advances and acts tod against the force of biasing spring 93 to open nozzle outlets 94.

Figure 4:
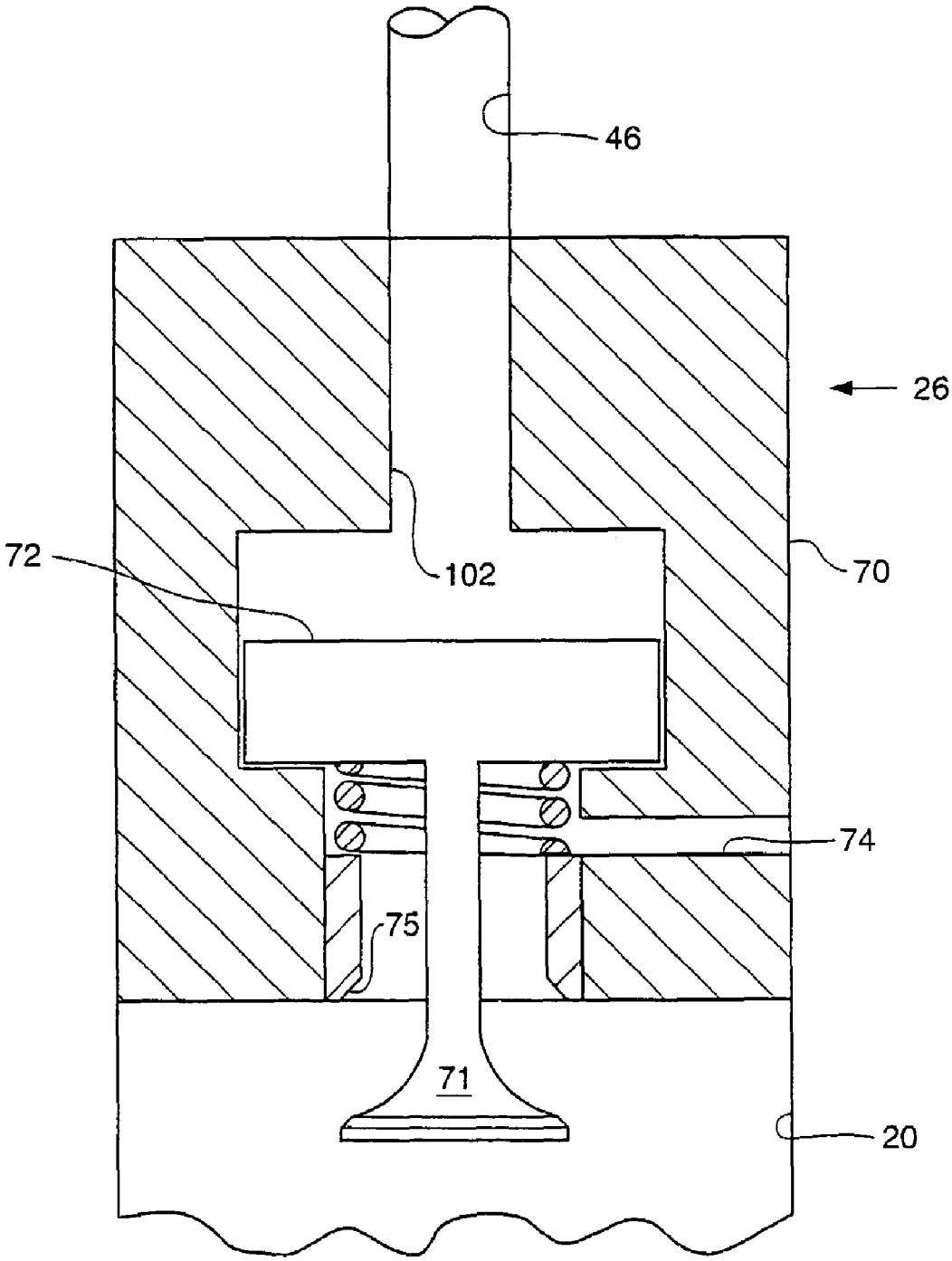
FIG. 4 is sectioned side diagrammatic representation of an engine compression release brake according to the present invention.

Referring now to FIG. 4, there is shown an engine compression release brake 26 fluidly connected to linear control valve 28 via brake supply/drain line 46 and second device passage 54. Engine compression release brake 26 is preferably any engine compression release brake that is positioned in engine 10 to vent compressed air within engine cylinder 20 toward the end of the compression stroke for engine piston 22.

Returning to fuel injection 24, control portion 81 of injector body 80 provides an electrical actuator 84, which is preferably a solenoid, that has an armature 85 attached to a seated pin valve member 86, which is positioned in injector body 80 and moveable between an upward position and a downward position (as shown). Those skilled in the art will recognize that electrical actuator 84 could instead be any suitable actuator, such as a piezoelectric actuator. Seated pin valve member 86 is preferably hydraulically balanced and mechanically biased toward its downward closed position by a biasing spring. When electrical actuator 84 is de-energized, such as between injection events, seated pin valve member 86 is moved to its downward position by the force of the biasing spring to close low pressure seat 88. When seated pin valve member 86 is in this position, pressure communication passage 90 is fluidly connected to injector supply/drain line 44 via a variable pressure passage. When electrical actuator 84 is energized, such as just prior to an injection event, seated pin valve member 86 is pulled to its upward position by armature 85 to open low pressure seat 88 and close high pressure seat 87. When seated pin valve member 86 is in this position, pressure communication passage 90 is blocked from fluid communication with injector supply/drain line 44 and opened to pressure vent 101 that is defined by injector body 80. Thus, when electrical actuator 84 is energized, pressure communication passage 90 is fluidly connected to low pressure vent 101 via variable pressure passage defined by control portion 81.

Returning to fuel injector 24, a direct control needle valve 99 is positioned in injector body 80 and has a direct control needle valve member that is movable between a first position, in which nozzle outlets 94 are open, and a downward second position, as shown, in which nozzle outlets 94 are blocked. Direct control needle valve member has an opening hydraulic surface 91 that is exposed to fluid pressure within nozzle supply passage 98 and a closing hydraulic surface 92 that is exposed to fluid pressure within needle control chamber 89. Pressure communication passage 90 is in fluid communication with needle control chamber 89 and controls fluid pressure within the same.

Closing hydraulic surface 92 and opening hydraulic surface 91 are preferably sized such that even when a valve opening pressure is attained in needle supply passage 98, direct control needle valve member will not lift open when needle control chamber 89 is fluidly connected to source of high pressure actuation fluid 34 via linear control valve 28 and injector supply/drain line 44. However, it should be appreciated that the relative sizes of closing hydraulic surface 92 and opening hydraulic surface 91 and the strength of biasing spring 93 should be such that when closing hydraulic surface 92 is exposed to low pressure in needle control chamber 89, the high pressure fuel acting on opening hydraulic surface 91 should be sufficient to move direct control needle valve 99 upward against the force of biasing spring 93 to open nozzle outlets 94.

Referring now to FIG. 4, there is shown an engine compression release brake 26 fluidly connected to linear control valve 28 via brake supply/drain line 46 and second device passage 54. Engine compression release brake 26 is preferably any engine compression release brake that is positioned in engine 10 to vent compressed air within engine cylinder 20 toward the end of the compression stroke for engine piston 22. It is known in the art that injection and combustion are not always necessary, or desirable, during each cycle of engine piston 20. One such time might be when a vehicle having engine 10 is descending a relatively steep hill. During the descent, injection and combustion are not necessary and instead braking is often desirable. To increase braking and efficiency of engine 10, and to decrease undesirable emissions created during unnecessary combustion, an engine compression release brake, such as engine compression release brake 26, is preferably operably coupled to each engine cylinder 20 of engine 10. This invention also contemplates less than all engine cylinders 20 including a compression release brake. When combustion is not desired, fuel is not injected into engine cylinder 20 at the end of the compression stroke, but instead, the compression of air in engine cylinder 20 during the compression stroke provides a retarding torque on engine 10. This energy is released by engine compression release brake 26 instead of being recovered as engine piston 22 moves toward its downward position.

Returning to engine 10 and engine compression release brake 26, as illustrated, linear control valve 28 functions as a flow control valve for engine compression release brake 26. Engine compression release brake 26 has an engine brake body 70 that defines a fluid passage 102. Fluid passage 102 is either fluidly connected to source of high pressure actuation fluid 34 or low pressure actuation fluid reservoir 30 via brake supply/drain line 46 controlled by linear control valve 28. A hydraulic actuator, piston 72, is positioned in engine brake body 70 and is movable between a retracted, upward position and an advanced, downward position as shown. Engine brake valve member 71 moves in a corresponding manner with piston 72. It should be appreciated that in addition to the hydraulic actuator provided in engine compression release brake 26, the exhaust valve for engine cylinder 20 could also have a conventional actuator that is coupled to a cam shaft (not shown).

Piston 72 is biased toward its retracted position by a biasing spring 73. When fluid passage 102 is fluidly connected to low pressure actuation fluid reservoir 30, piston 72 remains in its retracted position, and engine brake valve member 71 closes valve seat 75. Thus, engine compression release brake 26 is deactivated to prevent venting of exhaust from engine cylinder 20. However, when fluid passage 102 is fluidly connected to source of high pressure actuation fluid 34, piston 72 is moved to its advanced position toward a valve seat 75 against the action of biasing spring 73. Piston 72 pushes engine brake valve member 71 downward to open valve seat 75, allowing engine compression release brake 26 to open engine cylinder 20 to an exhaust passage 74.

Referring again to FIG. 2, linear control valve 28 has been shown with spool valve member 29 in its biased second position. Recall that linear control valve 28 can act as flow control valve for fuel injector 24 and engine compression release brake 26. It should be appreciated that if linear control valve 28 were acting as a pressure control valve for either one or both of these hydraulic devices, the linear position of spool valve member 29 would correspond to the connection of different passages within fuel injector 24 and engine compression release brake 26 to source of high pressure actuation fluid 34 and low pressure actuation fluid reservoir 30. As illustrated in FIG. 2, when spool valve member 29 is in its second biased position, both brake supply/drain line 46 and injector supply/drain line 44 are open to low pressure actuation fluid reservoir 30 via drain passage 52. In other words, when spool valve member 29 is in its second position, engine compression release brake 26 is deactivated and fuel injector 24 is in between injection events.

Referring to linear control valve 28 of FIG. 2, when spool valve member 29 is in its first position, engine brake supply/drain line 46 is open to drain passage 52, while injector drain/supply line 44 is fluidly connected to supply passage 51 via annulus 31 of spool valve member 29. When spool valve member 29 is in this first position, fluid passage 102 of engine compression release brake 26 is open to low pressure actuation fluid reservoir 30 and intensifier piston 95 is open to source of high pressure actuation fluid 34. High pressure acting on piston hydraulic surface 100 can move intensifier piston 95 to allow fuel within fuel pressurization chamber 97 to be raised to injection pressure levels. In other words, when linear control valve 28 is in first position, engine compression release brake 26 is deactivated and fuel injector 24 is preparing for an injection event.

When spool valve member 29 is in its third position, injector drain/supply line 44 is open to drain passage 52, while brake supply/drain line 46 is fluidly connected to supply passage 51 via annulus 31 of spool valve member 29. When spool valve member 29 is in third position, fluid passage 102 of engine compression release brake 26 is open to source of high pressure actuation fluid 34 and intensifier piston 95 is open to low pressure actuation fluid reservoir 30. High pressure acting on piston 72 and engine brake valve member 71 opens compressed air in engine cylinder 20 to be release through exhaust passage 74. In other words, when linear control valve 28 is in third position, engine compression release brake 26 is activated and fuel injector 24 is deactivated.

INDUSTRIAL APPLICABILITY

Referring to FIGS. 1–4, operation of the present invention will be discussed for one engine cylinder 20. It should be appreciated that while different cylinders are operating at different stages of their intake-compression-power-exhaust cycles at one time, the present invention operates in the same manner for each cylinder. Recall, in addition, that the present invention is being described for use with a four cylinder, four cycle engine 10. However, it should be appreciated that linear control valve 28 could find application in engines having a different number of cylinders or for those with cylinders operating under a different number of cycles.

Prior to the intake stage for engine cylinder 20, spool valve member 29 is in its biased second position such that fluid passage 102 of engine compression release brake 26 is fluidly connected to low pressure actuation fluid reservoir 30. Low pressure is therefore acting on piston 72 and engine brake valve member 71 such that engine compression release brake 26 is in an off condition and engine cylinder 20 is closed to exhaust passage 74. At the same time, fuel injector 24 is fluidly connected to low pressure actuation fluid reservoir 30 via injector supply/drain line 44. Low pressure is therefore acting on intensifier piston 95 and plunger 96 such that they are in their biased upward positions. Additionally, direct needle control valve 89 of fuel injector 24 is in its downward, biased position such that pressure communication passage 90 is fluidly connected to low pressure actuation fluid reservoir 30. Both closing hydraulic surface 92 and opening hydraulic surface 91 are exposed to low pressure, and direct control needle valve 99 is held in its downward position to close nozzle outlets 94 under the action of biasing spring 93.

As engine piston 22 moves downward toward its bottom position, it draws air into engine cylinder 20 via an intake valve (not shown). Near its bottom dead center position, the intake stroke is ended, the intake valve is closed, and engine piston 22 begins to advance toward its upward position to compress the air that has been drawn into engine cylinder 20. Preferably, it is during this advancing movement of engine piston 22 that electronic control module 16 determines if fuel injection will be desirable at the end of the compression stroke. If it is, electrical current is supplied through second terminal 59 such that second solenoid coil 57 pulls and first solenoid coil 56 pushes spool valve member 29 along center line 35 to its leftward first position to prepare fuel injector 24 for fuel injection. However, it should be appreciated that this determination could be made at any suitable time prior to the end of the compression stroke of engine piston 22.

When spool valve member 29 moves to its first position, brake supply/drain line 46 remains fluidly connected to low pressure actuation fluid reservoir 30, such that engine compression release brake 26 will not vent contents of engine cylinder 20. However, when spool valve member 29 is in first position, supply passage 51 is fluidly connected to first device passage 53 via annulus 31 of spool valve member 29. High pressure actuation fluid can now flow into first device supply passage 53. With high pressure actuation fluid flowing into injector supply/drain line 44, intensifier piston 95 and plunger 96 begin to move toward their advanced positions to pressurize fuel in fuel pressurization chamber 97 and nozzle supply passage 98. However, because closing hydraulic surface 92 is now exposed to high pressure in needle control chamber 89 via pressure communication passage 90, direct control needle valve 99 will not be moved to its upward position to open nozzle outlets 94. Further, it should be appreciated that intensifier piston 95 and plunger 96 move only a slight distance at this time because of hydraulic locking, which is a result of nozzle outlets 94 remaining closed. However, the slight movement of intensifier piston 95 and plunger 96 is still sufficient to raise fuel pressure within fuel pressurization chamber 97 to injection pressure levels.

Just prior to the desired start of injection, when engine piston 22 is near its top dead center position toward the end of the compression stroke, electrical actuator 84 is energized and armature 85 pulls seated pin valve member 86 toward its upward position closing high pressure seat 87 and, thus, blocking pressure communication passage 90 from the high pressure in injector supply/drain line 44 and opening it to low pressure via pressure vent 101. Needle control chamber 89 is now opened to low pressure. Because high pressure is no longer acting on closing hydraulic surface 92, the fuel pressure on opening hydraulic surface 91 in nozzle supply passage 98 is sufficient to overcome the bias of biasing spring 93, and direct control needle valve 99 moves to its open position to allow fuel injection into engine cylinder 20. When fuel is injected into engine cylinder 20, it ignites spontaneously due to the high temperature of the compressed air within engine cylinder 20. This combustion drives engine piston 22 downward for its power stroke.

Returning to fuel injector 24, when the desired amount of fuel has been injected into engine cylinder 20, electrical actuator is de-energized and seated pin valve member 86 is returned to its downward position under the force of the biasing spring to open high pressure seat 87. Pressure communication passage 90 is now open to high pressure, thus exposing closing hydraulic surface 92 to high pressure fluid in needle control chamber 89. The high pressure acting on closing hydraulic surface 92 is sufficient to move direct control needle valve 99 downward to close nozzle outlets 94 and end injection. Piston 95 and plunger 96 stop their advancing movement at this time, however, they do not immediately begin to retract because of hydraulic locking resulting from the continued high pressure acting on piston hydraulic surface 100 in injector supply/drain line 44. It should be appreciated if a split injection is desired, electrical actuator 84 could be re-energized at this time and seated pin valve member 86 would be returned to its upward position fluidly connecting pressure communication passage 90 with low pressure. With closing hydraulic surface 92 once again exposed to low pressure, and with high pressure still acting on opening hydraulic surface 91, direct control needle valve 99 would once again move to its open position.

Once the injection event is completed, second solenoid coil 57 is de-energized to allow spool valve member 29 to return to its second position under the action of second biasing spring 67 and first biasing spring 66. First device passage 53 is now closed to supply passage 51. Both first device passage 53 and second device passage 54 are opened to drain passage 52. Thus, brake supply/drain line 46 remains fluidly connected to low pressure actuation fluid reservoir 30, such that engine compression release brake 26 will not vent contents of engine cylinder 20. Injector supply/drain line 44 is also fluidly connected to low pressure actuation fluid reservoir 30, such that pressure acting on intensifier piston 95 and plunger 96 is reduced allowing intensifier piston 95 and plunger 96 to return to their upward position under the action of the biasing spring. As plunger 96 retracts, fuel from source of fuel fluid 18 can be drawn into fuel pressurization chamber 97 via fuel supply line 42. Recall that while closing hydraulic surface 92 is exposed to low pressure fluid via pressure communication passage 90, direct control needle valve 99 will remain in its closed position under the action of biasing spring 93 because low fuel fluid pressure is acting on opening hydraulic surface 91. As the components of fuel injector 24 are resetting themselves, engine piston 22 is advancing toward its top dead center position for its exhaust stroke to vent any residue from injection out of engine cylinder 20 via exhaust valve (not shown).

During a typical engine cycle, once engine piston 22 reaches the bottom dead center position for its power stroke, it begins to advance again for the exhaust stroke of the cylinder cycle. In other words, the engine brake valve member 71 is opened, usually by a cam, for the duration of the movement of engine piston 22 from its bottom dead center position to its top dead center position, and post combustion products remaining in engine cylinder 20 can be vented.

In some instances, when engine piston 22 is advancing toward the top dead center position of its compression stroke, electronic control module 16 and/or the operator determine that fuel injection is not desirable, and instead engine compression release brake 26 should be activated. At about top dead center, electrical current flows through first terminal 58 such that first solenoid coil 56 pulls and second solenoid 57 pushes spool valve member 29 along its center line 35 to its rightward third position against the action of first biasing spring 66. When spool valve member 29 is in this third position, injector supply/drain line 44 stays fluidly connected with low pressure actuation fluid reservoir 30 via drain passage 52. Because injector supply/drain line 44 is now exposed to low pressure, intensifier piston 95 and plunger 96 will remain in their upward, biased positions. In addition, direct control needle valve 99 will remain in its closed position under the force of biasing spring 93. Thus, fuel injector 24 is disabled and fuel injection will not take place.

However, when spool valve member 29 is in this third position, brake supply/drain line 46 becomes fluidly connected to source of high pressure actuation fluid 34 via second device passage 54. With brake supply/drain line 46 now opened to source of high pressure actuation fuel 34, piston 72 can now advance against biasing spring 73 to move engine brake valve member 71 off of valve seat 75, and engine compression release brake 26 can vent the contents of engine cylinder 20 via exhaust passage 74. This preferably occurs as the engine piston 22 approaches its top dead center position during its compression stroke to achieve maximum braking horsepower. In other words, in no contemplated case does the same engine cylinder undergo both an engine braking event and an injection event during the same cycle. It is this principal that allows a single actuator control valve, such as linear control valve 28, to be utilized in controlling the activation of both engine compression release brake 26 and fuel injector 24. Once the compressed air has been vented from engine cylinder 20, first solenoid coil 56 and second solenoid coil 57 of linear control valve 28 can be de-energized causing spool valve member 29 to move along its center line 35 back to its second position under the action of first biasing spring 66 and second biasing spring 67. When spool valve member 29 is in its second position, first device passage 53 and second device passage 54 are fluidly connected to low pressure actuation fluid reservoir 30. Brake supply/drain line 46 is open to low pressure actuation fluid reservoir 30, exposing piston 72 to low pressure and allowing the same to return to its retracted position under the action of biasing spring 73 to close exhaust passage 74.

It should be appreciated that the present invention provides a number of advantages over prior engine systems. For instance, because the number of fluid control valves has been reduced, the engine can be more robust. In addition, because there are fewer working components within the engine, there are fewer working components that can fail during engine operation. Further, because the fluid control valve is activated by two oppositely wound solenoid coils simultaneously pushing and pulling two permanent magnets, the force and the speed of the actuator is increased.

It should be understood that the above description is intended for illustrative purposes only, and is not intended to limit the scope of the present invention in any way. For instance, linear control valve 28 could include more than one supply passage possibly connected to fluid sources at different pressures. In addition, valve member could utilize a different biaser, such as hydraulic pressure forces, in place of biasing springs 66 and 67. Thus, those skilled in the art will appreciate that other aspects, objects and advantages of this invention can be obtained from a study of the drawings, the disclosure and the appended claims.

What is claimed is:

1. A hydraulic system comprising:

a source of high pressure fluid;

a low pressure reservoir;

a fuel injector;

an engine compression release brake;

a control valve having a valve member that is movable along a line to stop at one of a first position, a second position and a third position, and being fluidly positioned between said source of high pressure fluid, said low pressure reservoir, said fuel injector and said engine compression release brake.

2. The hydraulic system of claim 1 wherein said third position is located between said first position and said second position;

said fuel injector and said engine compression release brake being fluidly connected to said low pressure reservoir, but fluidly disconnected from said source of high pressure fluid, when said valve member is in said third position.

3. The hydraulic system of claim 2 wherein said fuel injector is fluidly connected to, but said engine compression release brake is fluidly disconnected from, said source of high pressure fluid when said valve member is in said first position; and said engine compression release brake is fluidly connected to, but said fuel injector is fluidly disconnected from, said source of high pressure fluid when said valve member is in said second position.

4. The hydraulic system of claim 3 wherein said engine compression release brake is fluidly connected to said low pressure reservoir when said valve member is in said first position; and said fuel injector is fluidly connected to said low pressure reservoir when said valve member is in said second position.

5. The hydraulic system of claim 3 including at least one biaser operably coupled to bias said valve member toward said third position.

6. The hydraulic system of claim 3 including first and second solenoid coils operably coupled to said valve member and being arranged in series in an electrical circuit; and said valve member being attracted to said first solenoid coil and repulsed by said second solenoid coil when electric current flows in one direction through said electrical circuit; and said valve member being repulsed by said first solenoid coil and attracted to said second solenoid coil when electric current flows in an opposite direction through said electric circuit.

7. The hydraulic system of claim 6 wherein said valve member includes a first permanent magnet adjacent said first solenoid coil; and said valve member includes a second permanent magnet adjacent said second solenoid coil.

8. The hydraulic system of claim 1 wherein said valve member includes an internal passage disposed therein.

9. The hydraulic system of claim 8 wherein said valve member includes opposite ends that are exposed to fluid pressure in said internal passage; and said internal passage is fluidly connected to said low pressure reservoir.

10. A method of operating a hydraulic system, comprising the steps of:

connecting a source of high pressure fluid, a low pressure reservoir, a fuel injector and an engine compression release brake to a control valve;

activating said fuel injector at least in part by moving a valve member of said control valve along a line to a first position that fluidly connects said fuel injector to said source of high pressure fluid;

activating said engine compression release brake at least in part by moving said valve member along said line to a second position that fluidly connects said engine compression release brake to said source of high pressure fluid; and deactivating said fuel injector and said engine compression release brake at least in part by moving said valve member along said line to a third position that fluidly connects said fuel injector and said engine compression release brake to said low pressure reservoir.

11. The method of claim 10 including a step of biasing said linear control valve toward said third position.

12. The method of claim 10 wherein said step of moving a valve member to a first position includes a step simultaneously pushing said valve member with a first electrical actuator and pulling said valve member with a second electrical actuator; and said step of moving said valve member to a second position includes a step of simultaneously pulling said valve member with said first electrical actuator and pushing said valve member with said second electrical actuator.

13. The method of claim 12 including a step of wiring said first and second electrical actuators in series on a single electrical circuit; and said first step of energizing includes a step of supplying current to said single electrical circuit in a first direction; and said second step of energizing includes a step of supplying current to said single electrical circuit in a second direction that is opposite to said first direction.

14. The method of claim 10 including a step of biasing said control valve toward said third position, which is a middle position;

said step of activating said fuel injector includes a step of magnetically moving said valve member in a first direction away from said middle position; and said step of activating said engine compression release brake includes a step of magnetically moving said valve member in a second direction away from said middle position.

15. The method of claim 10 including a step of pressure balancing said valve member at least in part by exposing opposite ends of said valve member to pressure in an internal passage disposed in said valve member.

16. An engine comprising:

an engine housing defining a plurality of cylinders;

a hydraulic system comprising:

a source of high pressure fluid;

a low pressure reservoir;

a fuel injector;

an engine compression release brake;

a control valve having a valve member that is movable along a line to stop at one of a first position, a second position and a third position, and being fluidly positioned between said source of high pressure fluid, said low pressure reservoir, said fuel injector and said engine compression release brake;

the hydraulic system being connected to said engine housing and including a fuel injector for each of said cylinders and an engine compression release brake for at least a portion of said cylinders, and including a control valve for each of said cylinders having both a fuel injector and an engine compression release brake; and each said control valve having a valve member movable along a line between a first position at which one fuel injector is fluidly connected to said source of high pressure fluid, a second position at which one engine compression release brake is fluidly connected to said source of high pressure fluid, and a third position at which said fuel injector and said engine compression release brake are fluidly connected to said low pressure reservoir.

17. The engine of claim 16 wherein each said control valve includes at least one biaser operably positioned to bias said valve member toward said third position; and each said control valve including at least one electrical actuator operably coupled to move said valve member.

18. The engine of claim 17 wherein said hydraulic system is fluidly connected to an engine lubrication system.

19. The engine of claim 18 wherein said engine compression release brake includes a piston operably coupled to an engine brake valve member.

20. The engine of claim 19 wherein each said fuel injector includes an intensifier piston.

* * * * *